United States Patent [19]

Carlson

[11] Patent Number: 4,941,414

[45] Date of Patent: Jul. 17, 1990

[54] STOVE HAVING A ROTATING FEED CYLINDER FOR PARTICULATE FUEL

[76] Inventor: Timothy R. Carlson, 20149-44th Ave. NE., Seattle, Wash. 98155

[21] Appl. No.: 325,266

[22] Filed: Mar. 17, 1989

[51] Int. Cl.[5] ..... F23K 3/10; F23K 3/16

[52] U.S. Cl. ..... 110/108; 110/110

[58] Field of Search ..... 110/102, 105, 108, 110, 110/226, 246, 186

[56] References Cited

U.S. PATENT DOCUMENTS

| | | | |
|---|---|---|---|
| 154,133 | 8/1874 | England . | |
| 554,453 | 2/1896 | McGiehan | 110/226 |
| 1,007,861 | 11/1911 | Gmeindl . | |
| 1,146,743 | 7/1915 | Thompson . | |
| 1,491,894 | 4/1924 | Atkinson | 110/226 |

*Primary Examiner*—Edward G. Favors

*Attorney, Agent, or Firm*—Larry A. Jackson; John M. Johnson

[57] ABSTRACT

A pellet fired stove has a rotating fuel feed cylinder for reliably and uniformly transporting pellet fuel from a hopper to the stove's combustion chamber. An open upstream end of the rotatable hollow feed cylinder communicates with a hopper containing solid fuel, such as wood pellets. The downstream end of the cylinder opens into a fuel chute leading to the combustion chamber. The fuel pellets from the hopper spill into the rotating hollow feed cylinder and form a sloping pellet bank within the cylinder. The rotation of the cylinder agitates the sloping bank of fuel sufficiently to cause a uniform quantity of fuel per cylinder revolution to be separated from the fuel bank and discharged from the cylinder into a combustion chamber.

22 Claims, 4 Drawing Sheets

STOVE HAVING A ROTATING FEED CYLINDER FOR PARTICULATE FUEL

BACKGROUND OF THE INVENTION

The present invention relates to stoves having solid fuel fired combustion chambers, and more particularly, to a fuel feed mechanism for reliably and uniformly feeding fuel pellets to the stove's combustion chamber for efficient and low pollution combustion.

Solid fuel feed systems often employ an auger based fuel transport mechanism. These auger systems commonly suffer from jamming due to pellets catching in the auger. An auger jam can burn out the control motor of the feed system. More importantly, the auger jam can result in a "burn back", or other hazardous ignition of fuel outside of the fire box.

The present invention, on the other hand, avoids control motor damage and combustion chamber "burn back" because the invention lacks an auger in which solid particulate fuel can jam. The feed cylinder of the present invention, unlike an auger, is of such a large cross-sectional area in relation to fuel pellet size that jamming is virtually impossible.

Furthermore, conventional solid fuel feed systems, including auger based systems, are subject to a non-uniform feeding of fuel into the combustion chamber. This non-uniform feeding results in uneven combustion, which in turn results in variable temperatures, raised pollution levels, and excessive smoke and soot.

In contrast, the substantially uniform fuel feed rate of the present invention produces even fuel combustion which results in constant temperatures, lower pollution levels, and minimal smoke and soot.

SUMMARY OF THE INVENTION

The present invention provides a mechanism which delivers a uniform rate of solid particulate fuel, such as wood pellets, to a combustion chamber in a jam-free manner. In accordance with the present invention, a hollow rotating feed cylinder mounted on a generally horizontal axis has an upstream end and a downstream end. A hopper communicates with the upstream end of the hollow feed cylinder and contains solid fuel pellets which spill into the open upstream end of the cylinder. The downstream end of the cylinder communicates with the stove's combustion chamber.

In operation, fuel pellets from the hopper spill into the upstream end of the feed cylinder and form a sloping pellet bank within the cylinder. The revolution of the cylinder agitates the sloping bank of fuel sufficiently to cause a consistent, uniform quantity of particulate fuel per cylinder revolution to be separated from the bank and discharged via the downstream end of the cylinder into the combustion chamber. The movement of the fuel down the sloping bank and out of the cylinder causes additional fuel to feed into the cylinder from the hopper.

Preferred features of the present invention include: a gear motor drive that powers the rotation of the cylinder; and gasket bearings for journaling the cylinder which are of a material having a low coefficient of friction and high temperature resistance.

Alternate embodiments of the present invention include a variable pitch, general horizontal axis for the feed cylinder to adjust feed rate. Also, a single motor may be employed to power the rotation of the feed cylinder and the combustion air fan. Finally, the feed cylinder may include channels, ribs or fins along its interior surface in order to alter the feed rate.

DESCRIPTION OF THE PREFERRED EMBODIMENT

The novel features believed to be characteristic of this invention are set forth in the appended claims. The invention itself, however, may best be understood and its various objects and advantages best appreciated by reference to the detailed description below in connection with the accompanying drawings.

Figure 1:
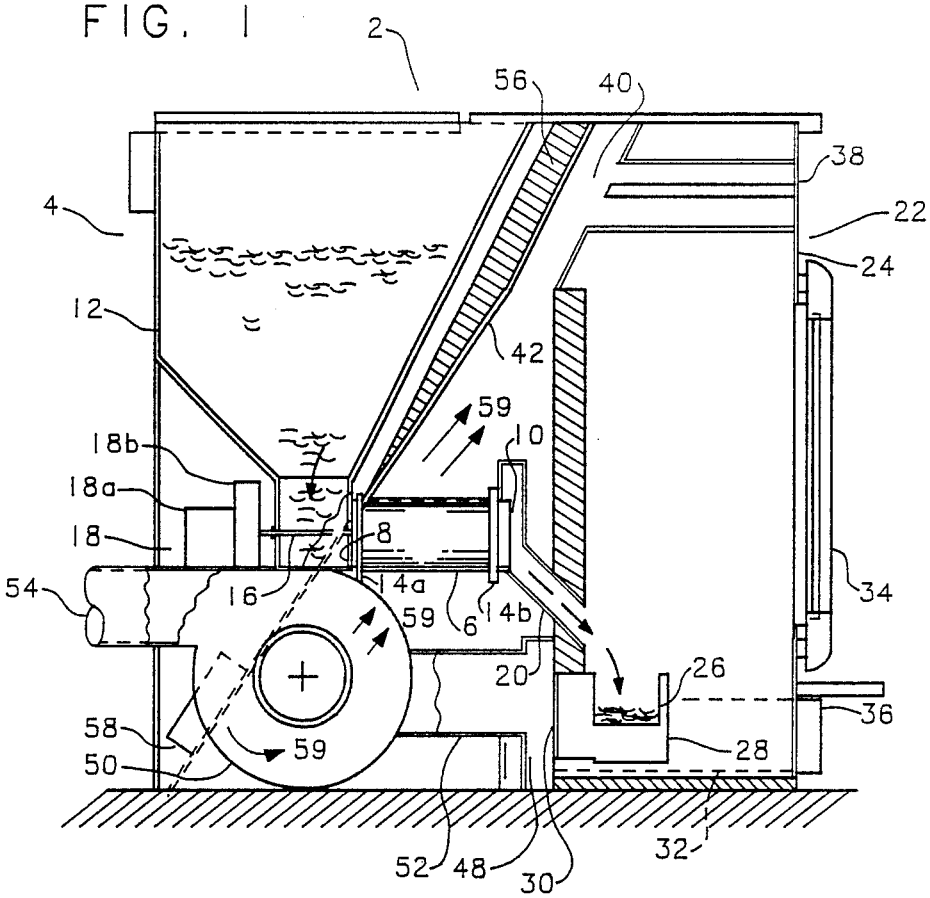
FIG. 1 is a vertical cross-sectional view of a feed cylinder and combustion chamber of a pellet fuel stove in accordance with the present invention.

In FIG. 1, reference numeral 2 indicates a pellet stove and pellet feed system as a whole. The pellet feed system 4, includes hollow feed cylinder 6 having an upstream end 8 and a downstream end 10. Upstream end 8 communicates with a constricted end of pellet hopper 12. At the upstream end 8 adjacent the connection with hopper 12, feed cylinder 6 is journaled in gasket bearing 14*a*. A drive "spider" 60 (see FIGS. 2 and 3) is located within upstream end 8 and is attached to drive axle 16, which passes through hopper 12 and is connected to gear motor 18 including gear assembly 18*b* and drive motor 18*a*.

The downstream end 10 of cylinder 6 is journaled in another gasket bearing 14*b* and communicates with pellet discharge chute 20. Chute 20 communicates feed cylinder 6 with the pellet stove 22 at firebox 24 of the stove.

Firebox 24 of the stove has burn grate 26 and burn pot 28 adjacent to pellet chute 20 for receipt of pellets from cylinder 6. Combustion air inlet 30, adjacent to burn pot 28, provides air for pellet combustion. Also adjacent to burn pot 28 is ash pan 32. Firebox 24 also has door 34 and ash pan door 36 formed in its front surface.

Above firebox 24 are convection air tubes 38 which join convection plenum 40, located behind firebox 24. Air plenum wall 42 is adjacent to convection plenum 40. Exhaust plenum 48 is attached to exhaust fan 50 via exhaust transition 52. Exhaust fan 50 is located underneath feed system 4 and vents air via exhaust exit 54. Between air plenum wall 42 and hopper 12 is insulation blanket 56 which provides shielding of the feed system from thermal energy.

To prevent feed cylinder 6 from becoming too hot, a fan 58 is mounted in the lower rear area of the stove behind plenum wall 42 and to one side of blower 50 to force cooling air indicated by arrows 59 from the external environment upwardly through convection plenum 40 and across the outer surface of cylinder 6 and out through air tubes 38.

Figure 2:
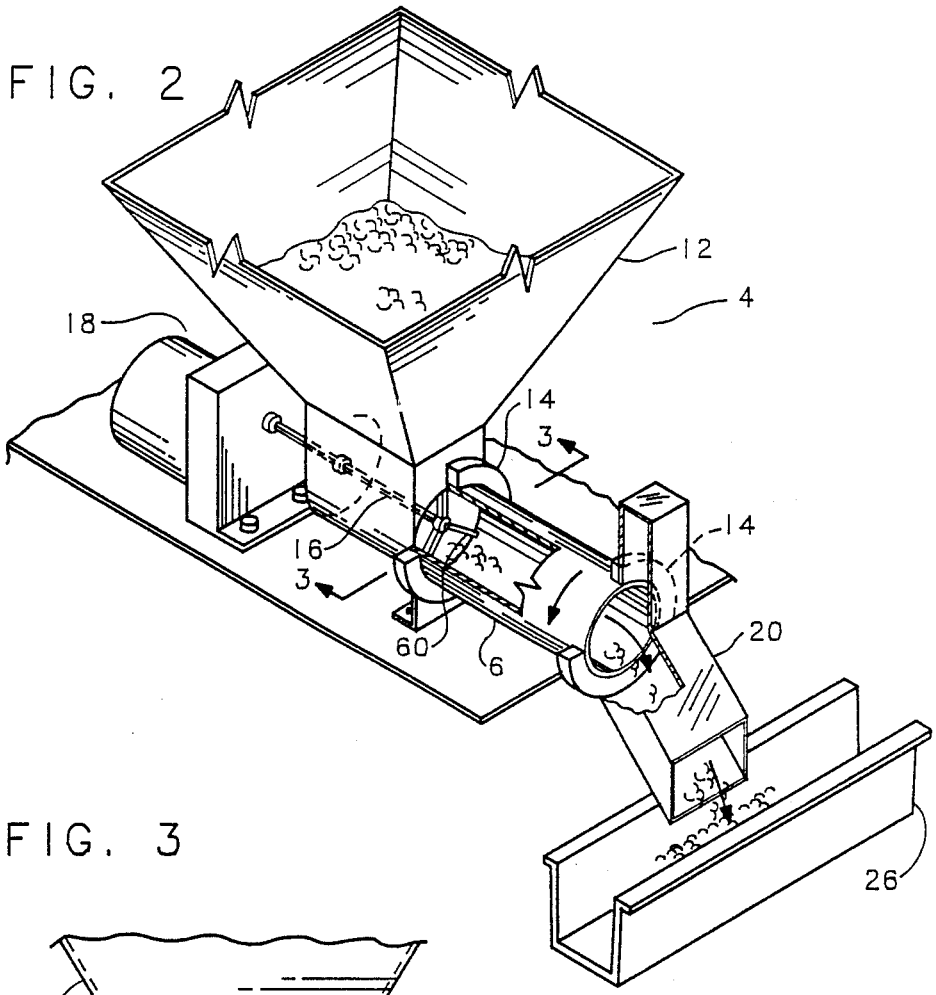
FIG. 2 is a perspective view of a rotating feed cylinder and associated components of the stove of FIG. 1.
Figure 3:
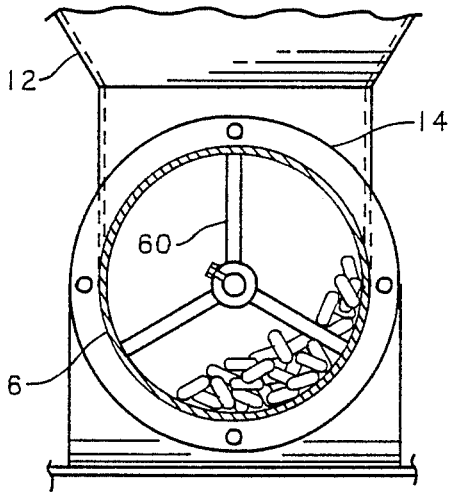
FIG. 3 is a sectional view taken at 3—3 of FIG. 2 of the feed cylinder of FIGS. 1 and 2.
Figure 4:
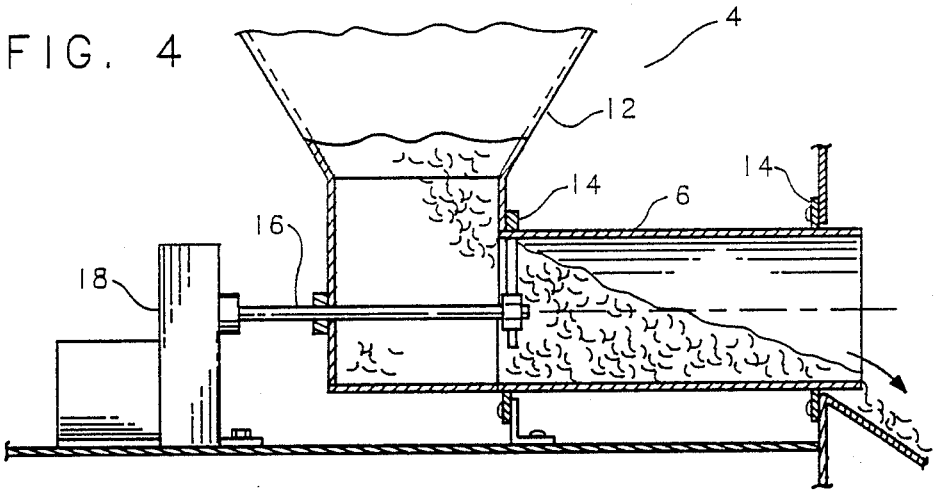
FIG. 4 is another cross-sectional view of the feed cylinder and associated components.

Referring now to FIGS. 2, 3 and 4, the operation of the invention is described. Fuel is loaded into the upper expanded portion of hopper 12. The size and shape of the fuel are preferably pellets, such as common wood pellets, between ⅛ and ⅜ inch in diameter, but may be of any size and shape particles ranging from sawdust to coal pieces.

The fuel from hopper 12 spills into the upstream end 8 of cylinder 6 and forms a sloping pellet bank within cylinder 6. Cylinder 6 revolves in either a clockwise or counterclockwise direction. The motion of cylinder 6 agitates the sloping bank of fuel sufficiently to cause a consistent quantity of fuel pellets per cylinder revolution to be separated from the pellet bank and discharged via downstream end 10 and pellet chute 20 onto burn grate 26 of burn pot 28. The movement of pellets down the sloping bank and out of cylinder 6 causes additional pellets to feed into cylinder 6 from hopper 12.

FIG. 3 shows that the fuel agitation caused by revolution of cylinder 6 results in displacement of the sloping pellet bank toward one side of the cylinder. Note, however, that this bank displacement is relatively small and that the agitation is not a violent mixing of the fuel pellets which would result in uneven feed due to the pellets becoming airborn and bouncing off the walls of cylinder 6.

The interior surface of cylinder 6 is preferably unpolished such as is characteristic of unfinished stock metal. However, the material comprising the cylinder's interior surface, and specifically the roughness of this surface, is not critical as long as a minimal coefficient of friction exists to produce pellet bank displacement onto one side of the cylinder during rotation. Under these conditions pellet movement along the interior length of cylinder 6 will result. For example, a stock stainless steel cylinder has an adequate coefficient of friction to cause pellet travel within cylinder 6.

Figure 7:
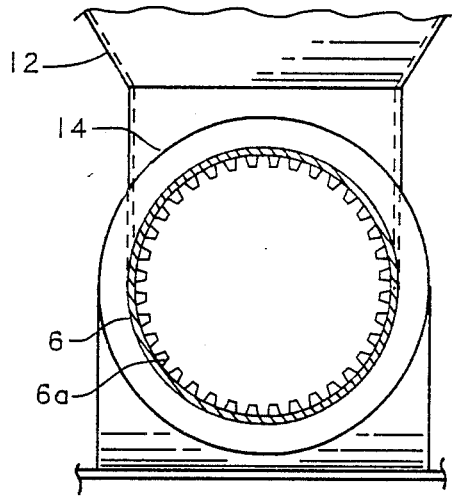
FIG. 7 is a sectional view of an alternate embodiment of the feed cylinder of the invention showing a cylinder interior having an uneven surface.

The interior of cylinder 6 is preferably of a uniform surface. However, the surface of cylinder 6 as shown in FIG. 7 may include rifling, channeling, uniform or random projections or depressions 6a to further agitate and force the pellets to travel. Similarly, the surface projections may take the form of paddles or fins on the interior of cylinder 6. The above additions serve to alter the pellet feed rate. Preferably, however, the cylinder interior wall is uniform with just sufficient roughness to cause the above described bank displacement.

The diameter of cylinder 6 is preferably about 3 inches, but may be between 1½ and 6 inches for solid fuel of between ⅛ inch and ⅜ inches in diameter. If solid fuel of larger diameter is employed, such as in industrial use, a cylinder of larger diameter may be used. Generally, as the diameter of cylinder 6 decreases toward the above minimum, the faster the fuel feeds; however, as the minimum diameter is reached, the constriction of the cylinder starts to slow the feed rate.

The length of cylinder 6 is preferably between 4 and 12 inches and preferably should have a length to inside diameter ratio about 2 to 3 for pellets of the ⅛ to ⅜ inch diameter, and is mainly relevant in varying the rate of feed of the fuel.

Figure 5:
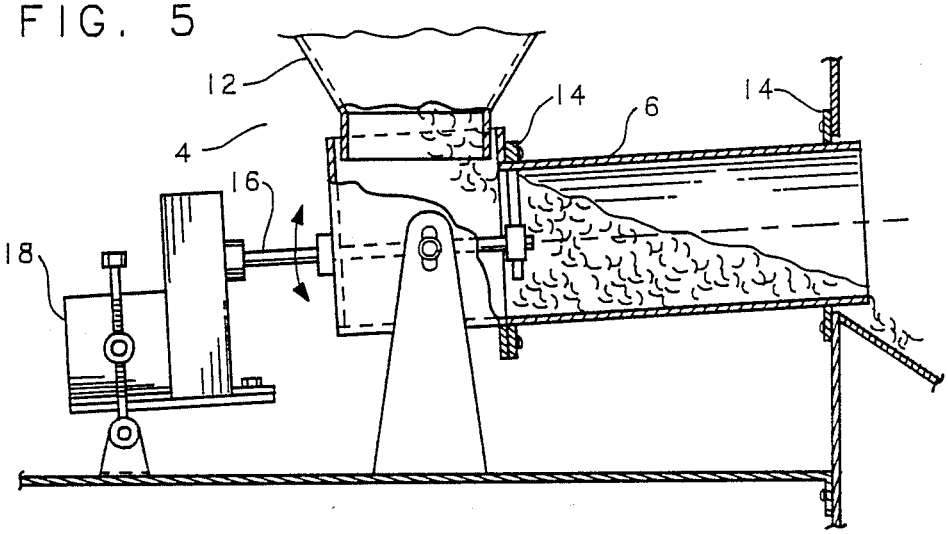
FIG. 5 is a cross-sectional view of an alternate embodiment of the present invention showing an adjustable pitch feed cylinder and associated components used in a pellet fired stove.

As shown in FIG. 5, an alternate embodiment of the present invention shows a cylinder 6 which is variable in pitch. The cylinder 6 may be angled either above or below horizontal in order to vary the rate of fuel feed. Also, adjusting the angle of cylinder 6 can provide the same feed rate for fuel pellets of different sizes. Specifically, cylinder 6 may be varied between 15° above horizontal and 35° below horizontal.

The revolution of cylinder 6 may provide almost uniform fuel feed in two different manners. In one embodiment, cylinder 6 revolves intermittently based on a potentiometer controlled timer of conventional design connected to the gear motor 18. Gear motor 18 is thus activated on a duty cycle for a variable number of seconds. In this manner, a uniform number of pellets (for example, 5) may be fed from cylinder 6 into burn grate 26 and burn pot 28 with a fixed passage of time (for example, 10 seconds) occurring before the next group of pellets are fed. Thus cylinder 6 revolves for a certain time period (for example, 3 seconds) and does not revolve for another predetermined time period (for example, 7 seconds) based on the period of activation of motor 18a. In this embodiment, the cylinder may perform one or more complete revolutions or only a partial revolution per feed event.

In another embodiment, a uniform rate of fuel feed is attained whereby gear motor 18 is continuously activated, but the speed of motor 18a is varied. Thus, cylinder 6 revolves continuously and the rate of pellets fed into burn pot 28 is a function of the revolutions per minute of cylinder 6, which is in turn a function of the speed of gear motor 18.

Drive gasket bearings 14a and 14b are preferably made of a heat resistant, resilient material having a low coefficient of friction. The above properties are required in order to create a gasket which can provide relatively frictionless turning of the cylinder, which can withstand the high temperatures from combustion within firebox 24, and which can provide a relatively air tight seal. An example of material having the properties required by gasket bearings 14 is polytetrafluroethelene, available under the brand name TEFLON ®.

The drive mechanism provided by spider 60 and axle 16 as shown in FIGS. 2 through 5 is only one possible drive means. Note that spider 60 is solely a means of attaching axle 16 to cylinder 6 and does not aid in the agitation of the fuel in cylinder 6. The rotation of cylinder 6 and gravity are the sole mechanisms of agitation.

Figure 6:
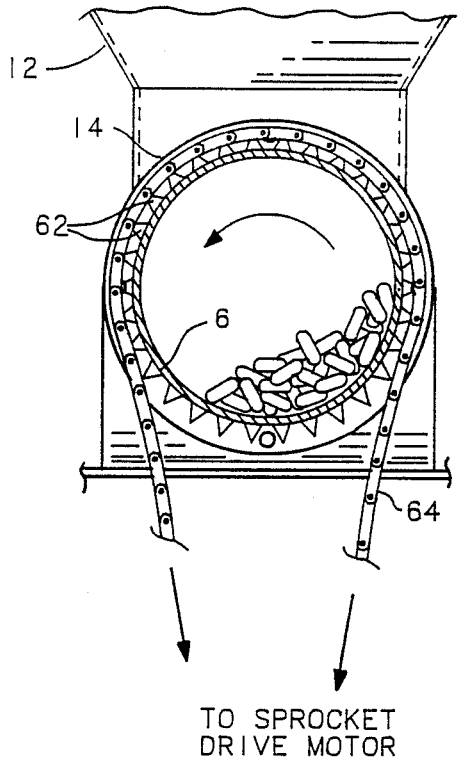
FIG. 6 is a sectional view of an alternate embodiment of the feed cylinder of the invention showing a rim drive.

An alternate embodiment having a drive combination different from the spider/axle is disclosed in FIG. 6. This rim drive system has a sprocket 62 attached circumferentially to cylinder 6, and a chain 64 attached to both sprocket 62 and a sprocket drive motor, not separately shown. The drive motor can be in common with one or both of the motor driven blowers 50 and 58.

Note that gear motor 18 of FIGS. 1–5 is used to power only the feed cylinder in this embodiment of the invention. The use of a single motor for the feed system 4 and the exhaust fan 50 (and/or plenum circulation fan 58) is not only more cost effective than separate motors but also results in a safer combustion system. In a dual or multiple motor system, if the fan motor stops operating, the feed motor continues to operate, discharging more fuel without adequate air circulation and increasing the chance of "burn back", or ignition of fuel outside of burn pot 28. In the common motor embodiment of this invention, "burn back" cannot occur because fuel feed will cease if the common motor stops.

The operation of this invention using the feed system 4 embodiment (FIGS. 1–5) avoids "burn back" caused by two other occurrences. In conventional auger type systems "burn back" may result from jamming of the fuel feed system due to blockage of the auger. Because feed cylinder 6 cannot be jammed by the fuel pellet being fed, "burn back" cannot occur during operation of the present invention. "Burn back" also occurs in a conventional system because the pellets absorb excessive thermal energy from the firebox after attaining a temperature of 400°-500° F. However, the operation of the present invention includes fan 58 which forces atmospheric air across feed cylinder 6 via convection plenum 40. Thus, the temperature of the pellets within feed cylinder 6 is approximately 120° F., a temperature too low to induce "burn back".

The substantially uniform pellet feed attained by the operation of the invention results in combustion which is less varied than that of conventional feed systems, such as auger feeds. The operation of the present invention which results in feed uniformity is described in detail above. The relative non-uniformity of auger feed systems is due to the fact that the size of the discharge opening formed by an auger rotating at the discharge end of a cylinder changes at least three times per auger revolution. Therefore, an auger feed system which revolves $\frac{1}{3}$ turn for each discharge event may feed, for example, 2 pellets, then 7 pellets and finally 20 pellets as each $\frac{1}{3}$ revolution is completed, thereby creating an erratic burn cycle.

The uniformity of pellets fed by the present invention results in more even combustion, which in turn provides less temperature variation, less combustion pollution, a higher combustion efficiency and a cleaner combustion (less smoke and soot) than conventional systems. The data on pollution levels for this invention shows that carbon monoxide levels of 4.46 grams/hour (3.04 grams/Kg) and hydrocarbon levels of 2.78 grams/hour (1.89 grams/Kg) are attainable. These pollution levels are about one-half the pollution levels of most pellet stoves having conventional pellet feed systems. The combustion efficiency for this invention is believed to be significantly higher than stoves having a conventional auger feed but being otherwise comparable.

The present invention produces less smoke and soot because pellet stoves having conventional auger feed systems must be suppled with more air than needed for small pellet discharge events, such as only 2 pellets, in order to adequately combust the larger discharge events of, for example, 20 pellets. This excessive air volume inhibits the combustion of the smaller number of pellets, and smoke from smoldering pellets results. In operation of the present invention, on the other hand, the relatively uniform feed of the pellets allows the operator to select a precise, steady volume of air necessary to combust the fuel pellets efficiently without smoldering.

While particular embodiments of the present invention have been described in some detail above, changes and modifications may be made in the illustrated embodiments without departing from the form or spirit of the invention. It is therefore intended that the following claims cover all equivalent modifications and variations which fall within the scope of the invention as defined by the claims.

I claim:

1. In a stove having a combustion chamber, a solid particulate fuel feed system cooperating with said combustion chamber, said fuel feed system comprising:

a fuel hopper for holding solid particulate fuel;

a hollow feed cylinder disposed with its longitudinal axis lying generally horizontal and mounted for rotation about said axis, said hollow feed cylinder having an open entry end in communication with said fuel hopper and a discharge end; and a drive means for rotating said cylinder such that solid particulate fuel in said hopper feeds into said hollow cylinder so as to form a bank of fuel sloping downwardly from said entry end to said discharge end, the solid particulate fuel traveling in said bank in said hollow cylinder and being uniformly discharged into said combustion chamber of the stove due to rotational motion of said hollow cylinder.

2. The solid particulate fuel feed system of claim 1 wherein said drive means intermittently rotates said hollow feed cylinder in a periodic manner and said solid particulate fuel is fed in uniform amounts to said combustion chamber.

3. The solid particulate fuel feed system of claim 1 wherein said drive means rotates said hollow feed cylinder in a substantially continuous manner and said solid particulate fuel travels substantially continuously within said hollow feed cylinder.

4. The solid particulate fuel system of claim 1 wherein said drive means powers both a fan means and rotation of said hollow feed cylinder.

5. The solid particulate fuel feed system of claim 1 wherein said hollow feed cylinder has an interior surface which is relatively smooth.

6. The solid particulate fuel feed system of claim 1 wherein said hollow feed cylinder has an uneven interior surface.

7. The solid particulate fuel feed system of claim 1 wherein said hollow feed cylinder has an interior surface and further comprising ribs or channels disposed generally longitudinally on said interior surface.

8. A particulate fired combustion chamber of a heating stove having an automatic particulate feed comprising:

a fuel hopper for holding solid particulate fuel;

a hollow feed cylinder having first and second open ends, said first open end communicating with said fuel hopper, said second open end communicating with a combustion chamber of said heating stove, said hollow feed cylinder mounted for rotation about its longitudinal axis; and a drive means for rotating said cylinder, whereby solid particulate fuel in said fuel hopper feeds into said first open end of said hollow feed cylinder to form a bank of fuel sloping downwardly from the first to second ends, the solid particulate fuel traveling within said bank in said hollow feed cylinder by reason of rotation of said cylinder to said second open end where the particulate fuel is uniformly discharged into said combustion chamber.

9. The particulate fired combustion chamber having an automatic particulate feed of claim 8 wherein said drive means rotates said hollow feed cylinder in a periodic manner and said solid particulate fuel is periodically discharged into said combustion chamber in uniform batches.

10. The particulate fired combustion chamber having an automatic particulate feed of claim 8 wherein said drive means rotates said hollow feed cylinder in a continuous manner and said solid particulate fuel is continuously and uniformly discharged into said combustion chamber.

11. The particulate fired combustion chamber having an automatic particulate feed of claim 8 wherein said combustion chamber is used in an area heating stove.

12. The particulate fired combustion chamber having an automatic particulate feed of claim 8 and a combustion air fan, and wherein said drive means powers both said combustion air fan and rotates said hollow feed cylinder.

13. The particulate fired combustion chamber having an automatic particulate feed of claim 8 wherein said hollow feed cylinder has an interior surface which is relatively smooth but unpolished.

14. The particulate fired combustion chamber having an automatic particulate feed of claim 8 wherein said hollow feed cylinder has an interior surface formed with longitudinally extending channels.

15. The particulate fired combustion chamber having an automatic particulate feed of claim 8 wherein said hollow feed cylinder has an interior surface and further comprising ribs disposed longitudinally on said interior surface.

16. A solid fuel feed mechanism for transporting solid particulate fuel to a combustion chamber comprising:

a fuel hopper for holding solid particulate fuel;

a hollow feed cylinder having first and second open ends, said first open end communicating with said fuel hopper, said second open end communicating with a combustion chamber, said hollow feed cylinder mounted for rotation about its longitudinal axis;

a means for adjusting the mounting of said hollow feed cylinder so that its longitudinal axis lies at an adjustable angle relative to horizontal; and a drive means for rotating said cylinder, whereby solid particulate fuel in said fuel holding receptacle feeds into said hollow feed cylinder and is caused to travel therewithin by reason of rotation of said cylinder to said second open end where the particulate fuel is uniformly discharged into a combustion chamber.

17. The solid fuel feed mechanism of claim 16 wherein said drive means rotates said hollow feed cylinder in a periodic manner and said solid particulate fuel is periodically discharged into said combustion chamber in uniformly sized batches.

18. The solid fuel feed mechanism of claim 16 wherein said drive means rotates said hollow feed cylinder in a continuous manner and said solid particulate fuel is continuously and uniformly discharged into said combustion chamber.

19. The solid fuel feed mechanism of claim 16 wherein said drive means powers both a fan means and rotation of said hollow feed cylinder.

20. The solid fuel mechanism of claim 16 wherein said hollow feed cylinder has an interior surface which is relatively smooth.

21. In a stove having a combustion chamber, a solid particulate fuel feed system cooperating with said combustion chamber, said fuel feed system comprising:

a fuel hopper for holding solid particulate fuel;

a hollow feed cylinder disposed with its longitudinal axis lying generally horizontal and mounted for rotation about said axis, said hollow feed cylinder having an open entry end in communication with said fuel hopper and a discharged end;

a fan means; and a drive means for powering said fan and rotating said cylinder such that solid particulate fuel in said hopper feeds into said hollow cylinder and travels therewithin to said combustion chamber of the stove due to rotational motion of said hollow cylinder.

22. A particulate fire combustion chamber of a heating stove having an automatic particulate feed comprising:

a fuel hopper for holding solid particulate fuel;

a hollow feed cylinder having first and second open ends, said first open end communicating with said fuel hopper, said second open end communicating with a combustion chamber of said heating stove, said hollow feed cylinder mounted for rotation about its longitudinal axis;

a fan means; and a drive means for powering said fan and rotating said cylinder, whereby solid particulate fuel in said fuel hopper feeds into said first open end of said hollow feed cylinder and is caused to travel therewithin by reason of rotation of said cylinder to said second open end where the particulate fuel is uniformly discharged into said combustion chamber.

* * * * *